US008357880B2

(12) United States Patent
Chu

(10) Patent No.: US 8,357,880 B2
(45) Date of Patent: Jan. 22, 2013

(54) FAR INFRARED RAY CERAMIC PLATE HEATING MODULE

(75) Inventor: Yunyuan Chu, Taipei (TW)

(73) Assignee: JingDeZhen Fared Technology Co., Ltd., Jiangxi Province (CN)

( * ) Notice: Subject to any disclaimer, the term of this patent is extended or adjusted under 35 U.S.C. 154(b) by 465 days.

(21) Appl. No.: 12/741,335

(22) PCT Filed: Nov. 26, 2007

(86) PCT No.: PCT/CN2007/003335

§ 371 (c)(1),
(2), (4) Date: May 4, 2010

(87) PCT Pub. No.: WO2009/065265

PCT Pub. Date: May 28, 2009

(65) Prior Publication Data

US 2010/0266267 A1 Oct. 21, 2010

(30) Foreign Application Priority Data

Nov. 22, 2007 (CN) ..... 2007 1 0177906

(51) Int. Cl.
*H05B 3/68* (2006.01)
*A45D 20/40* (2006.01)

(52) U.S. Cl. ..... 219/466.1; 219/443.1; 219/444.1; 219/468.1; 219/541; 219/544; 219/553; 219/467.1; 392/407

(58) Field of Classification Search ..... 219/466.1, 219/467.1, 443.1, 444.1, 468.1, 541, 544, 219/553; 392/407
See application file for complete search history.

(56) References Cited

OTHER PUBLICATIONS

International Search Report in Chinese with mailing date of Aug. 14, 2008.
International Search Report in English with mailing date of Aug. 14, 2008.

*Primary Examiner* — Shawntina Fuqua
(74) *Attorney, Agent, or Firm* — WPAT, P.C.; Anthony King

(57) ABSTRACT

A far infrared ray ceramic flat plate heating module is provided. The far infrared ray ceramic flat plate heating module includes a ceramic heat-generating flat plate, an integrated terminal block for electrical distribution, a metal plate and a metal frame. The ceramic heat-generating flat plate includes a ceramic flat plate, a heat-generating film coated on a surface of the ceramic flat plate, silver paste electrodes configured on and coupled to two opposite sides of the heat-generating film, a first insulating layer coated on the heat-generating film and the silver paste electrodes, a temperature sensor configured by forming a temperature sensing paint layer on the first insulating layer, and a second insulating layer formed on the temperature sensor. The integrated terminal block is secured on the metal plate. The metal frame is disposed surrounding the periphery of the metal plate and the ceramic heat-generating flat plate.

11 Claims, 2 Drawing Sheets

FAR INFRARED RAY CERAMIC PLATE HEATING MODULE

BACKGROUND OF THE INVENTION

1. Field of the Invention

The present invention relates generally to a far infrared ray ceramic flat plate heating module, and more particularly, to a far infrared ray ceramic flat plate heating module configured by forming a far infrared ray heating film, a silver paste electrode, a first insulating layer, a temperature sensing paint layer, output contact point terminals, a second insulating layer on a ceramic flat plate. Such a far infrared ray ceramic flat plate heating module can be widely applied in producing many products, such as heat radiators, BBQ grills, and clean furnaces.

2. The Prior Arts

Heat radiators are very popular in the temperate zone and the cold zone, and have become standardized equipment in recently built buildings. Conventional heat radiators generally include fin-type heat radiators, quartz tube heaters, oil burning heaters, and positive temperature co-efficient (PTC) ceramic forced-draft heaters. Typically, a conventional fin-type heat radiator is operated by forming an inner thermal circulation with hot water or hot kerosene for continuously heating the fins. The fins then heat up the air therearound thus configuring a convection of the heated air. The fin-type heat radiators are usually known as featured with a low energy efficiency and requiring a long time for achieving the desired temperature. As to the quartz tube heater, it includes a nickel-chrome wire received in a quartz tube for generating hot red light radiation. Such a radiation is a visible light radiation and is also featured with a low energy efficiency. Even further, such a hot red light often makes people feel uncomfortable, and when being radiated for a long time, the skin of the user may even be tanned or burned. On another hand, when the quartz tube is heated to a high temperature, it may explode and injuries the user. Regarding the oil burning heaters, they combust oil to obtain heat. However, when the oil is combusted, it consumes oxygen, and incomplete combustion of oil usually generates carbon monoxide which may cause intoxication of the user. Further, a PTC ceramic forced-draft heater utilizes forced hot air circulation for heating. However, when water is splashed on the PTC ceramic plate, it may explode. Further, the PTC ceramic plate contains lead oxide ingredient, and therefore the production of the PTC ceramic forced-draft heaters may cause lead pollution.

BBQ grill is an ordinary cookware. A conventional BBQ grill is typically fabricated by burying a nickel-chrome heating tube in an aluminum casting flat plate. The surface designed for contacting the food is coated with a Teflon layer for avoiding sticking. However, the food cooked with such a conventional BBQ grill often lose lots of water content, thus having an unsatisfactory mouth feel.

Furthermore, a typical clean furnace employ a microcrystalline glass (also known as glass-ceramic) serving as a heating panel, and a high-power halogen tube is used as the heat source. Such a clean furnace is attributed to an indirect heating approach and relies upon visible light heat-radiation.

In view of the above-mentioned disadvantages and difficulties of the foregoing conventional technologies, and responsive to the demand for healthy, environment-friendly, and energy saving lifestyle, a new-generation far infrared ray nano heating film and thick carbon heating film have been developed. However, in practical use, such films are required to be formed on a carrier which is insulated and high heat-resistant. Ceramic substrates are believed to be a good choice for serving as the carriers. However, ceramic material is usually brittle and is often broken under external impact. As such, a far infrared ray ceramic flat plate heating module which is fast-heated, safe, healthy, and environment-friendly, is very much desired for being employed in the foregoing products as a solution of the above-mentioned disadvantages and difficulties thereof.

SUMMARY OF THE INVENTION

A primary objective of the present invention is to provide a far infrared ray ceramic flat plate heating module. The far infrared ray ceramic flat plate heating module is not likely to be broken by external impact so as to cause an electric shock hazard.

The far infrared ray ceramic flat plate heating module includes a ceramic heat-generating flat plate, an integrated terminal block, a metal plate, and a metal frame.

The ceramic heat-generating flat plate includes a ceramic flat plate, a heat-generating film coated on a surface of the ceramic flat plate, silver paste electrodes configured on and coupled to two opposite sides of the heat-generating film, a first insulating layer coated on the heat-generating film and the silver paste electrodes, a temperature sensor configured by forming a temperature sensing paint layer on the first insulating layer. Each of the silver paste electrodes has a contact point exposed out from the first insulating layer, and the contact points of the silver paste electrodes serve as power supplying contact points of the heat-generating film. The temperature sensing paint layer is preferably formed by a temperature sensing paint and is configured as a polygonal open loop. The polygonal open loop breaks at a certain position with two terminals. The two terminals of the polygonal open loop are coated with silver paste for forming two contact points of the temperature sensor. When the ceramic heat-generating flat plate generates heat, a resistance variation between the two contact points of the temperature sensor is detected by a circuit. Therefore, an input power of the ceramic heat-generating flat plate is adjusted according to the detected resistance variation for controlling a temperature of the ceramic heat-generating flat plate.

The integrated terminal block includes input/output contact point terminals. The input/output contact point terminals are electrically coupled to the power supplying contact points of the heat-generating film and the contact points of the temperature sensor. The integrated terminal block is secured on the metal plate.

The metal frame is disposed surrounding a periphery of the ceramic heat-generating flat plate, and the ceramic heat-generating flat plate is secured on the metal plate.

The present invention has the following advantages:

1. The far infrared ray ceramic flat plate heating module of the present invention employs a metal frame and a metal plate for securing and protecting the ceramic heat-generating flat plate from being broken by external impact and electric shock hazard caused thereby. The far infrared ray ceramic flat plate heating module of the present invention produces the heat in the form of far infrared ray which is beneficial to people's health. When employed for warming, the far infrared ray ceramic flat plate heating module of the present invention is adapted for providing a comfortable and warm condition for the user. When employed in a BBQ grill, the far infrared ray ceramic flat plate heating module of the present invention is adapted for maintaining the delicious taste of the food. When employed in a clean furnace, the far infrared ray ceramic flat plate heating module of the present invention is adapted for achieving a higher efficiency; and 2. The far infrared ray ceramic flat plate heating module of the present invention has a simple and compatible structure, which can be conveniently used in designing far infrared ray heating products.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
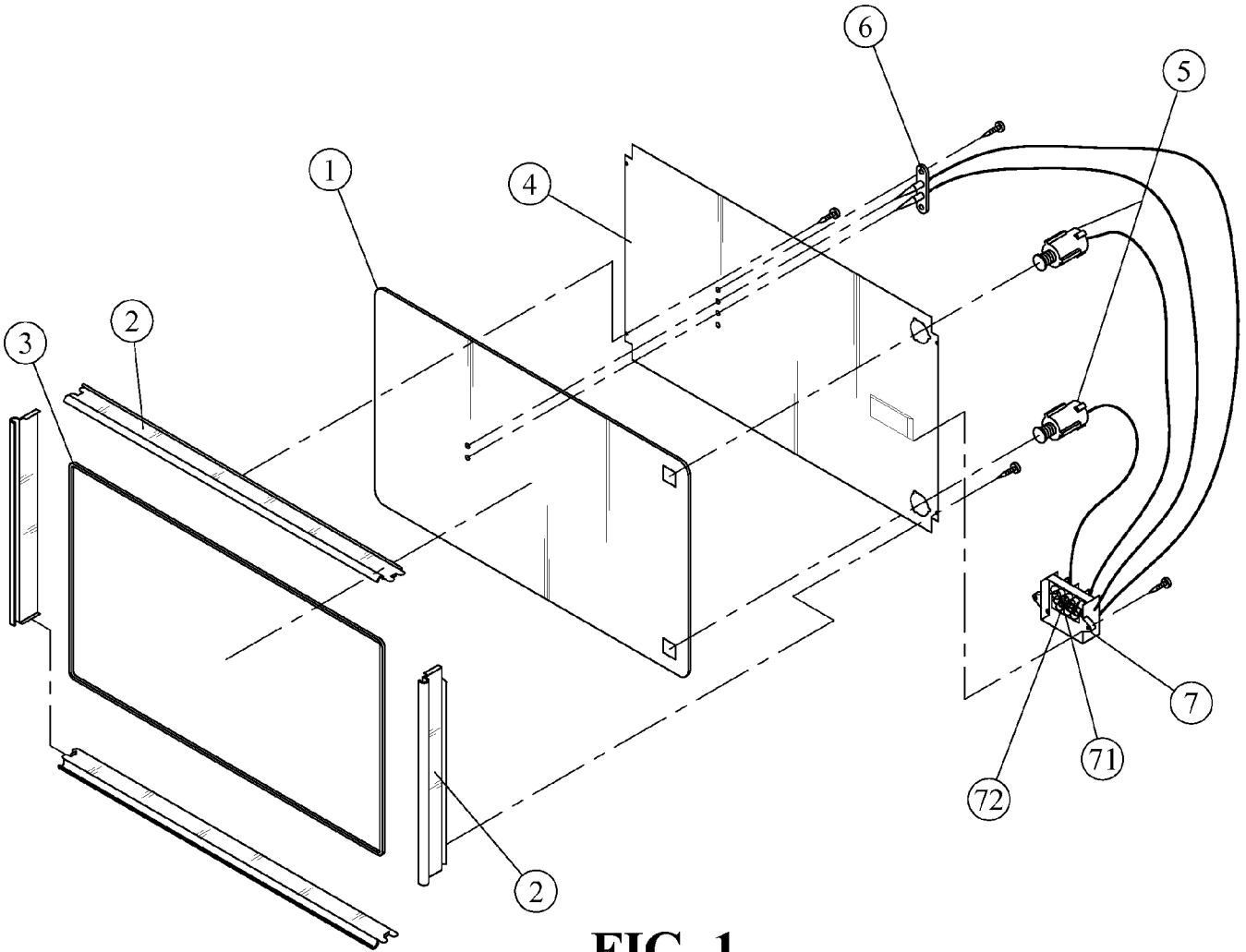
FIG. 1 is a perspective exploded view of a far infrared ray ceramic flat plate heating module according to an embodiment of the present invention.

The accompanying drawings are included to provide a further understanding of the invention, and are incorporated in and constitute a part of this specification. The drawing illustrates embodiments of the invention and, together with the description, serves to explain the principles of the invention.

Figure 2:
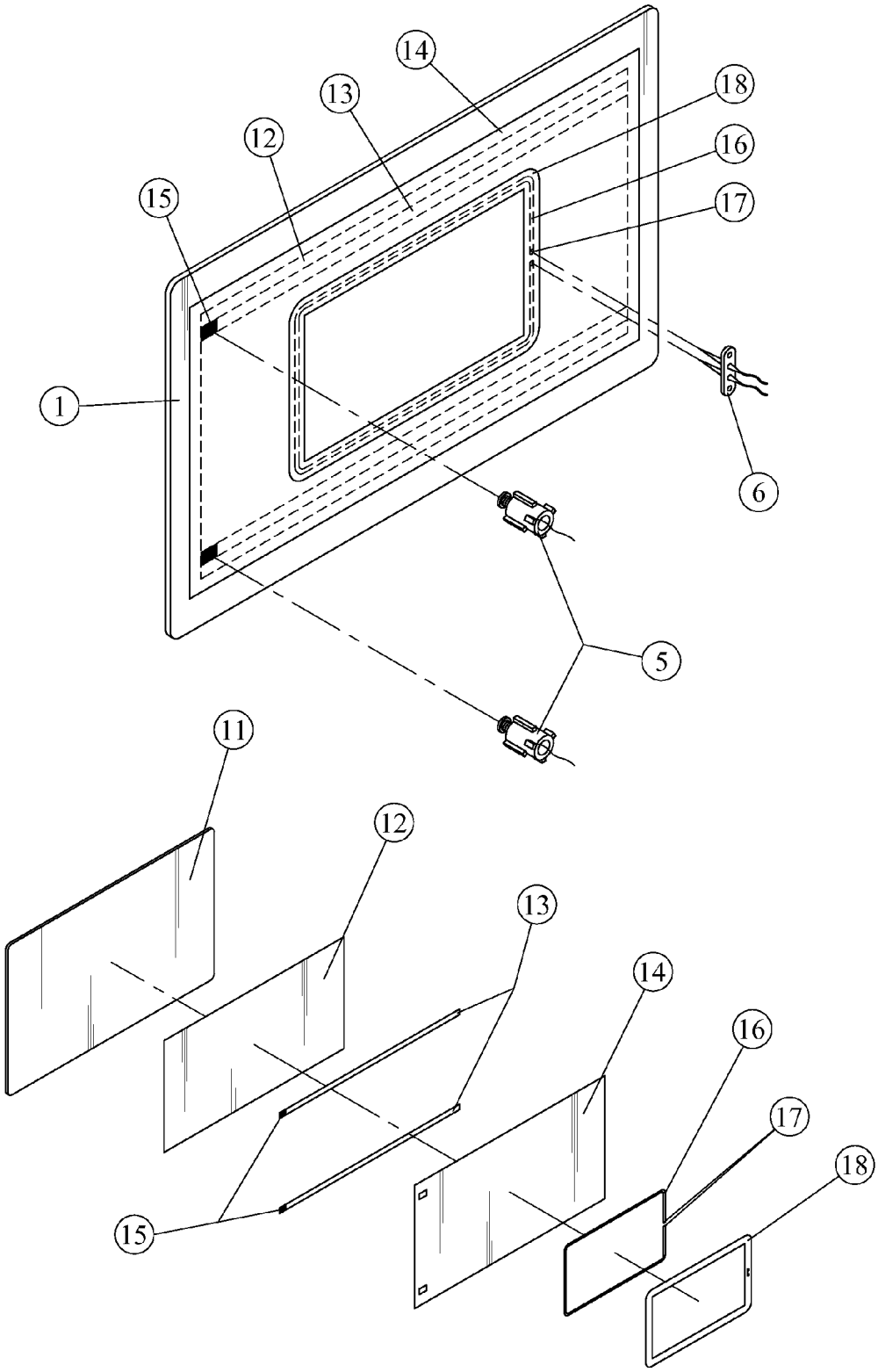
FIG. 2 is a perspective exploded view of a ceramic heat-generating flat plate of the far infrared ray ceramic flat plate heating module according to an embodiment of the present invention.

Referring to FIGS. 1 and 2, a far infrared ray ceramic flat plate heating module according to an embodiment of the present invention includes a ceramic heat-generating flat plate 1, an integrated terminal block 7, a frame fixing element, a metal plate 4, and a metal frame 2.

The ceramic heat-generating flat plate 1 includes a ceramic flat plate 11, a heat-generating film 12 coated on a surface of the ceramic flat plate 11, silver paste electrodes 13 configured on and coupled to two opposite sides of the heat-generating film 12, a first insulating layer 14 coated on the heat-generating film 12 and the silver paste electrodes 13, a temperature sensor configured by forming a temperature sensing paint layer 16, and a second insulating layer 18 on the first insulating layer 14. The ceramic flat plate 11 for example is an aluminum oxide ceramic plate or a microcrystalline glass plate. The silver paste electrodes 13 are formed in strip type, and configured by coating a silver paste at the two opposite sides of the heat-generating film 12. When a power supply is provided over the two silver paste electrodes, the heat-generating film 12 obtains power therefrom so as to heat up the ceramic flat plate 11. The heat-generating film 12 for example can be a heat-generating thick film such as a thick carbon heating film, or heat-generating thin film such as a nano heating film. Each of the silver paste electrodes 13 has a contact point exposed out from the first insulating layer 14, and the contact points of the silver paste electrodes 13 serve as power supplying contact points 15 of the heat-generating film 12. The temperature sensing paint layer 16 is preferably formed by a temperature sensing paint and is configured as a polygonal open loop having a breaking point. The polygonal open loop presents two terminals at the breaking point. The two terminals of the polygonal open loop are coated with silver paste for forming two contact points 17 of the temperature sensor. The temperature sensing paint for example can be a negative temperature coefficient (NTC) thermistor paint or a positive temperature coefficient (PTC) thermistor paint. The polygonal open loop for example is but not restricted to be a rectangular loop. The second insulating layer 18 is provided for protecting the temperature sensing paint layer 16 and improving the anti-creeping performance of the ceramic heat-generating flat plate 1. The second insulating layer 18 for example is made of aluminum oxide. The two contact points 17 of the temperature sensor is exposed from the second insulating layer 18. When the ceramic heat-generating flat plate 1 generates the heat, a resistance variation between the two contact points 17 of the temperature sensor is detected by a circuit. Therefore, an input power of the ceramic heat-generating flat plate 1 is adjusted according to the detected resistance variation for controlling a temperature of the ceramic heat-generating flat plate 1. In case the ceramic flat plate 11 is broken by an external impact, the polygonal open loop is cut off, and the resistance of the temperature sensing paint layer 16 connected between the two contact points 17 of the temperature sensor become infinite. In such a way, the power supply is immediately cut off, so as to avoid the electric shock hazard.

The metal frame 2 is disposed surrounding a periphery of the ceramic heat-generating flat plate 1, and the ceramic heat-generating flat plate 1 is secured at one side of the metal plate 4 for enforcing the strength of the ceramic heat-generating flat plate 1 against external impact. Furthermore, the metal plate 4 is adapted for reflecting the far infrared ray emitted from the ceramic heat-generating flat plate 1 so as to lower the temperature at the bottom side of the ceramic flat plate 11. According to an aspect of the embodiment, the far infrared ray ceramic flat plate heating module further includes power supplying input terminals 5 and an output terminal 6 of the temperature sensor. The power supplying input terminals 5 and the output terminal 6 of the temperature sensor are secured on the metal plate. As shown in FIGS. 1 and 2, the power supplying input terminals 5 are coupled in direct contact with the power supplying contact points 15, and the output terminal 6 is coupled in direct contact with the two contact points 17 of the temperature sensor.

The frame fixing element is composed of a heat-resistant rubber ring frame 3. The heat-resistant rubber ring frame 3 for example is made of a silica gel, and is provided between the metal frame 2 and a periphery of the ceramic heat-generating flat plate 1 for providing a shock-absorbing buffer therebetween.

The integrated terminal block 7 is secured on the metal plate 4. The integrated terminal block 7 includes input/output contact point terminals. The power supplying contact points 15 of the ceramic heat-generating flat plate 1, and the two contact points 17 of the temperature sensor are electrically coupled to the input/output contact point terminals via the power supplying input terminals 5 and the output terminal 6. The integrated terminal block 7 further includes a temperature switch 71 and a temperature fuse 72 at a side adjacent to the ceramic flat plate 11. When the operation temperature is abnormal, the temperature switch 71 is cut off to stop the power supplying to the ceramic heat-generating flat plate 1. When the abnormal temperature condition sustains for a certain time, the temperature fuse 72 is blown to stop the power supplying to the ceramic heat-generating flat plate 1. In such a way, in case the ceramic heat-generating flat plate 1 works in an abnormal condition, the far infrared ray ceramic flat plate heating module can be protected from being damaged or causing a fire or electric shock hazard.

In summary, the present invention provides a far infrared ray ceramic flat plate heating module, adapted for being applied in many products such as heat radiators, BBQ grills, and clean furnaces. The far infrared ray ceramic flat plate heating module is modularized so as to allow designers to design applicable, power saving, and safe far infrared ray heating products with the far infrared ray ceramic flat plate heating module of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A far infrared ray ceramic flat plate heating module, comprising:

a ceramic heat-generating flat plate, comprising:

a ceramic flat plate;

a heat-generating film coated on a surface of the ceramic flat plate;

silver paste electrodes configured on and coupled to two opposite sides of the heat-generating film;

a first insulating layer coated on the heat-generating film and the silver paste electrodes, wherein each of the silver paste electrodes has a contact point exposed out from the first insulating layer, and the contact points of the silver paste electrodes serve as power supplying contact points of the heat-generating film; and a temperature sensor configured by forming a temperature sensing paint layer on the first insulating layer, wherein the temperature sensing paint layer is formed by a temperature sensing paint and is configured as a polygonal open loop, wherein the polygonal open loop breaks at a certain position with two terminals, and the two terminals of the polygonal open loop are coated with silver paste for forming two contact points of the temperature sensor;

a metal plate, wherein the ceramic heat-generating flat plate is secured on the metal plate;

an integrated terminal block, being secured on the metal plate and comprising input/output contact point terminals configured thereon, wherein the input/output contact point terminals are electrically coupled to the power supplying contact points of the heat-generating film and the contact points of the temperature sensor; and a metal frame disposed surrounding a periphery of the ceramic heat-generating flat plate.

2. The far infrared ray ceramic flat plate heating module as claimed in claim 1, wherein the polygonal open loop is a rectangular open loop

3. The far infrared ray ceramic flat plate heating module as claimed in claim 1, wherein the ceramic heat-generating flat plate further comprises a second insulating layer coated on the temperature sensing paint layer, and the contact points of the temperature sensor are exposed out from the second insulating layer.

4. The far infrared ray ceramic flat plate heating module as claimed in claim 1, further comprising a heat-resistant rubber ring frame provided between the metal frame and a periphery of the ceramic heat-generating flat plate for providing a shock-absorbing buffer therebetween.

5. The far infrared ray ceramic flat plate heating module as claimed in claim 1, wherein the ceramic flat plate is an aluminum oxide ceramic plate or a microcrystalline glass plate.

6. The far infrared ray ceramic flat plate heating module as claimed in claim 1, wherein the heat-generating film is a carbon heating film, or a nano heating film.

7. The far infrared ray ceramic flat plate heating module as claimed in claim 1, wherein the first insulating layer is made of aluminum oxide.

8. The far infrared ray ceramic flat plate heating module as claimed in claim 3, wherein the second insulating layer is made of aluminum oxide.

9. The far infrared ray ceramic flat plate heating module as claimed in claim 1, wherein the far infrared ray ceramic flat plate heating module further comprises power supplying input terminals of the ceramic heat-generating flat plate and an output terminal of the temperature sensor, wherein the power supplying contact points of the ceramic heat-generating flat plate, and the two contact points of the temperature sensor are electrically coupled to the input/output contact point terminals via the power supplying input terminals and the output terminal.

10. The far infrared ray ceramic flat plate heating module as claimed in claim 1, wherein the temperature sensing paint is a negative temperature coefficient (NTC) thermistor paint or a positive temperature coefficient (PTC) thermistor paint.

11. The far infrared ray ceramic flat plate heating module as claimed in claim 4, wherein the heat-resistant rubber ring frame is made of a silica gel material.

* * * * *